United States Patent [19]

Sugimori et al.

[11] Patent Number: 4,732,607

[45] Date of Patent: Mar. 22, 1988

[54] METHOD OF CONTROLLING THE STIRRING STRENGTH AND FLOW RATE OF A JET OF GAS BLOWN THROUGH A LANCE ONTO A MOLTEN METAL SURFACE

[75] Inventors: Takashi Sugimori, Minoo; Sakae Furujo, Nara, both of Japan

[73] Assignee: Sumitomo Metal Industries, Ltd., Osaka, Japan

[21] Appl. No.: 933,188

[22] Filed: Nov. 21, 1986

[30] Foreign Application Priority Data

Nov. 26, 1985 [JP] Japan ..... 60-265782

[51] Int. Cl.[4] ..... C21C 7/00

[52] U.S. Cl. ..... 75/59.13; 75/59.15; 266/81; 266/87; 266/89

[58] Field of Search ..... 75/59.13, 59.15; 266/81, 87, 89

[56] References Cited

U.S. PATENT DOCUMENTS 3,540,879 11/1970 Carlson ..... 75/59.13

3,598,386 8/1971 Murphy ..... 75/59.15

3,837,841 9/1974 Kutscher ..... 75/59.15

3,871,871 3/1975 Denis ..... 75/59.13

*Primary Examiner*—Peter D. Rosenberg

*Attorney, Agent, or Firm*—Burns, Doane, Swecker & Mathis

[57] ABSTRACT

A method of controlling independently of each other the stirring strength of a jet of oxygen gas and the flow rate of the oxygen gas to be blown onto a molten metal bath in a top-blowing oxygen furnace is disclosed. The method comprises providing an oxygen supplying conduit with a means of detecting the temperature of the supplied oxygen gas, a means of detecting the pressure thereof, and a means of heat-exchanging with the supplied oxygen gas, controlling the temperature and pressure of the oxygen supplied so that the stirring strength of the jet of oxygen gas and/or the flow rate of the oxygen gas are controlled independently of each other with the top-blowing lance being kept at a predetermined position.

7 Claims, 2 Drawing Figures

METHOD OF CONTROLLING THE STIRRING STRENGTH AND FLOW RATE OF A JET OF GAS BLOWN THROUGH A LANCE ONTO A MOLTEN METAL SURFACE

BACKGROUND OF THE INVENTION

This invention relates to a method of controlling the stirring strength of a jet of gas such as oxygen gas as well as the flow rate of the gas independently of each other without changing the height of a lance in a top-blowing oxygen furnace for producing steel, a top-blowing oxygen furnace for making copper, a top-blowing oxygen furnace for gasifying coal, and the like, each having a molten metal bath therein (hereinafter collectively referred to as "top-blowing oxygen furnace"). In particular, this invention relates to a method of increasing or decreasing the stirring strength of a jet of oxygen gas while maintaining at a given level the flow rate of the oxygen gas blown onto the surface of a molten metal bath without changing the height of an oxygen top-blowing lance. Alternatively, this invention relates to a method of increasing or decreasing the flow rate of a jet of oxygen gas without changing the stirring strength of the oxygen gas.

It is well known that the stirring strength of a jet of oxygen gas blown through a top-blowing lance has a great influence on the stirring of a molten metal bath and on gas-liquid interface reactions in the molten metal bath. For example, under the same conditions, the reactions at the interface proceed rapidly when the stirring strength of a jet of oxygen gas increases. On the other hand, the interface reactions becomes moderate when the stirring strength of a jet of oxygen gas decreases. Furthermore, oxidation reactions proceed rapidly when an oxygen gas supply increases, and even a reducing reaction sometimes occurs when the flow rate of oxygen gas decreases.

Therefore, the main controlling factors of the operation of a top-blowing oxygen furnace are the stirring strength of a jet of oxygen gas and the supply of oxygen gas. Thus, numerous measures have been proposed to control the stirring strength and the supply of a jet of oxygen gas. The supply of oxygen gas can be controlled very easily merely by controlling valves. However, when the flow rate of oxygen gas is changed, the stirring strength of a jet of the oxygen gas is also changed and vice versa, making it difficult to control the supply of oxygen gas independently of the stirring strength of a jet of the oxygen gas.

The "stirring strength of a jet of oxygen gas" means the strength of a jet of oxygen gas blown onto a molten metal surface to stir a molten metal bath and can be described as follows, presuming that the position of a lance is fixed.

Stirring Strength to a Molten Metal Bath $$\propto (\text{Oxygen Gas Jet Momentum}) \times (\text{Lance Height from the Surface of Molten Metal Bath})^{-3} \quad \text{(I)}$$

Oxygen Gas Jet Momentum $$\propto (\text{Oxygen Gas Flow Rate}) \times (\text{Oxygen Gas Jet Speed at the Outlet of Lance})$$

$$\propto (\text{Pressure of Oxygen Gas at the Inlet of Lance}) \quad \text{(II)}$$

From the above Formulas (I) and (II),

Stirring Strength to a Molten Metal Bath $$\propto (\text{Pressure of Oxygen Gas at the Inlet of Lance}) \times (\text{Lance Height from the Surface of Molten Metal Bath})^{-3} \quad \text{(III)}$$

As is apparent from the above Formula (III), the following methods have been employed in the prior art so as to control the stirring strength of a jet of oxygen gas: (a) a method of sliding up and down a lance through which oxygen gas is supplied; (b) a method of changing the momentum of a jet of oxygen gas, i.e., changing the pressure of the oxygen gas supplied, which inevitably results in a change in the flow rate of the oxygen gas.

However, Method (a) above has disadvantages that a lance has to be replaced frequently since the tip of the lance is vigorously attacked by splashed molten metal and molten slag when the lance is lowered down toward the molten metal bath surface. In addition, a lance-sealing mechanism which assists the movement of the lance has to resist the bending which occurs during operation, making the sealing apparatus very expensive. Maintenance costs are also expensive.

On the other hand, in Method (b) above, since a change in pressure results in a change in flow rate, a change in reaction conditions is inevitable, and it is impossible to control the stirring strength of a jet of oxygen gas effectively without changing the flow rate of the oxygen gas.

It has been thought that it is impossible to control the flow rate and the stirring strength of oxygen gas independently of one another. Namely, it is impossible to increase or decrease the supply of oxygen gas without changing the stirring strength. Nor is it possible to increase or to decrease the stirring strength of a jet of oxygen gas without changing the flow rate of the oxygen gas supplied through a lance. Therefore, it is necessary to vary the height of the lance in order to control the operation of a top-blowing oxygen furnace.

For example, in refining a low carbon steel with a top-blowing oxygen converter, it is necessary to reduce the flow rate of oxygen gas in order to prevent an excess oxidation of molten iron at a finishing stage of refining. However, if the flow rate of oxygen gas is reduced, the stirring strength is also reduced. Therefore, a lance has to be lowered toward the surface of a molten metal bath in order to maintain the stirring strength.

In addition, in the case of a gasification furnace, sometimes it is necessary to suppress the stirring of a molten metal bath to some extent in order to reduce the thermal damage to the furnace body. In such a case it is necessary to either decrease the flow rate of oxygen gas or to raise the lance. However, if the flow rate of oxygen gas is decreased, the capacity of a gasification furnace is decreased. Therefore, the lance has to be raised, since the capacity of the gasification furnace cannot be reduced in order to maintain a given output of gas.

SUMMARY OF THE INVENTION

An object of this invention is to provide a method of controlling the stirring strength of a jet of oxygen gas independently from the flow rate of the oxygen gas supplied through a lance onto a molten metal surface without changing the height of the lance.

Another object of this invention is to provide a method of controlling the supply of oxygen gas through a lance while maintaining the stirring strength of a jet of the oxygen gas at a given level without changing the height of the lance.

Still another object of this invention is to provide a method of controlling the stirring strength of a jet of oxygen gas while maintaining the supply of oxygen gas through a lance at a given level without changing the height of the lance.

The inventors of this invention have noted that the flow rate of oxygen gas supplied through a lance can be expressed as follows:

$$\text{Oxygen Gas Flow Rate at the Inlet of Lance} = C \times A_{th} \times (\text{Oxygen Gas Pressure at the Inlet of Lance}) \times (\text{Oxygen Gas Temperature at the Inlet of Lance})^{-\frac{1}{2}} \quad \text{(IV)}$$

(wherein, "C" is a constant, and "$A_{th}$" is the cross-sectional area of the throat of the lance nozzle).

In the prior art, as explained before, it has been thought that the pressure of the oxygen gas supplied through a top-blowing lance is in proportion to the momentum of the oxygen gas, i.e., the stirring strength of a jet of oxygen gas when the height of a lance is held constant, and changing the pressure inevitably results in a change in the flow rate of the oxygen gas as well.

However, according to the findings of the inventors of this invention, as is apparent from the above Formula (IV), it is possible to control the stirring strength of a jet of oxygen gas as well as the flow rate of the oxygen gas independently of one another without changing the height of a lance by controlling not only the temperature of the oxygen gas but also the pressure thereof.

For example, merely by increasing or decreasing the temperature of oxygen gas, it is possible to decrease or increase the flow rate of the oxygen gas while maintaining the pressure thereof constant to keep the stirring strength thereof constant. This is because the stirring strength is proportional to the pressure of oxygen gas and is independent of the temperature of the oxygen gas. On the other hand, by increasing the pressure of the oxygen gas, the stirring strength is increased with an increase in the flow rate of the oxygen gas. In this case, too, by raising the temperature of the oxygen gas it is possible to maintain a constant flow rate of the oxygen gas to be supplied through the lance.

Thus, the invention is a method of independently controlling the stirring strength of a jet of oxygen gas as well as the flow rate of the oxygen gas to be blown onto a molten metal bath in a top-blowing oxygen furnace, which comprises providing an oxygen supplying conduit with a means of detecting the temperature of the supplied oxygen gas, a means of detecting the pressure thereof, and a means of heat-exchanging with the supplied oxygen gas, controlling the temperature and pressure of the oxygen supplied so that the stirring strength of a jet of oxygen gas and/or the flow rate of the oxygen gas are controlled independently of each other with the top-blowing lance being kept at a predetermined position.

In a further preferred embodiment, this invention is a method of controlling the stirring strength of a jet of oxygen gas in a top-blowing oxygen furnace independently of the flow rate of the oxygen gas, which comprises providing an oxygen gas supplying conduit with a means of detecting temperature, a means of detecting pressure, and a means of heat-exchanging with the supplied oxygen gas, controlling the stirring strength by changing the pressure of the oxygen gas in the conduit, and congtrolling the flow rate by changing the temperature of the supplied oxygen gas so as to achieve a desired level of stirring strength of a jet of oxygen gas independently of the flow rate of the oxygen gas blown through the lance onto the surface of the molten metal bath. The method is effective either for controlling the content of CO gas of the product gas, or for controlling the stirring of a molten metal bath.

Thus, according to this invention, the momentum, i.e., the stirring strength of a jet of oxygen gas is varied merely by changing the pressure of the oxygen gas, and it is possible to control the stirring strength of a jet of oxygen gas while maintaining the flow rate of the oxygen gas supplied through the lance constant by changing the temperature. It is also possible to control the flow rate of the oxygen gas merely by changing the temperature thereof while maintaining the stirring strength of a jet of oxygen gas constant, these all being done without changing the height of a lance.

DETAILED DESCRIPTION OF THE PREFERRED EMBODIMENTS

With reference to the attached drawings, this invention will be further described in detail.

This invention will be illustrated by taking as an example the cases in which the top-blowing oxygen furnace is a top-blowing oxygen converter for steel making, or a top-blowing oxygen furnace for gasifying coal.

Figure 1:
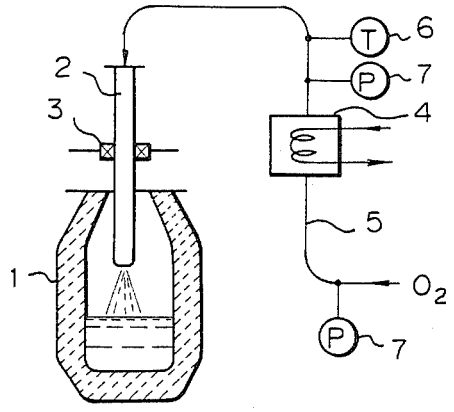
FIG. 1 is a diagrammatical illustration of a top-blowing oxygen furnace for steel making, to which a method of this invention is applied.

FIG. 1 is a diagrammatic illustration of an oxygen converter, in which a top-blowing oxygen converter 1 is provided with a top-blowing oxygen lance 2 having a lance-sealing mechanism 3. Oxygen gas is supplied to the lance 2 through an oxygen gas supplying conduit 5 via a heat-exchanger 4. Reference numerals 6 and 7 indicate a thermometer and pressure gauges, respectively.

In the apparatus shown in FIG. 1, oxygen gas is supplied through the oxygen gas supplying conduit 5 to the oxygen lance 2 via the heat-exchanger 4, and is blown onto the surface of the molten metal bath. During operation the position or level of the oxygen lance 2 is fixed to keep a constant distance between the tip of the lance and the surface of the molten metal bath. Usually, according to the conventional apparatus, the height of the lance is suitably varied during operation.

When it is required to further reduce the carbon content at a finishing stage of refining of a low carbon steel, it is necessary to reduce the flow rate of oxygen gas while increasing the stirring strength of the molten metal bath. In this case, according to this invention, the pressure of the oxygen gas is raised to increase the stirring strength of the oxygen gas, and the temperature of oxygen gas is increased with the heat-exchanger 4 so as to maintain or reduce the flow rate of the oxygen gas. On the other hand, at the initial stage of steel refining, it is necessary to increase the flow rate of the oxygen gas while maintaining the stirring strength thereof at a given level. In this case, according to this invention the temperature of the oxygen gas to be supplied is lowered with the heat-exchanger 4 while maintaining the pressure thereof constant.

Thus, according to this invention, the supply of oxygen gas can be controlled by adjusting the temperature thereof independently of the pressure, and thus independently of the stirring strength.

When it is required to increase the stirring strength of a jet of oxygen gas without changing the supply of oxygen gas, according to this invention, not only the pressure of the oxygen gas but also the temperature thereof are raised. In addition, when it is required to decrease the stirring strength of a jet of oxygen gas without changing the supply of the oxygen gas, not only the pressure of the oxygen gas but also the temperature thereof are reduced.

Namely, according to this invention it is possible to increase the momentum of a jet of oxygen gas while maintaining the flow rate of the oxygen gas constant by adjusting the pressure of the oxygen gas as well as the temperature thereof.

In applying the present invention to the apparatus of FIG. 1, the temperature of the oxygen gas is adjusted by means of the heat-exchanger 4 on the basis of data measured by the thermometer 6. In addition, in case the pressure of the oxygen is to be adjusted, the adjustment is carried out by means of valve control on the basis of data measured by the pressure gauges 7.

Figure 2:
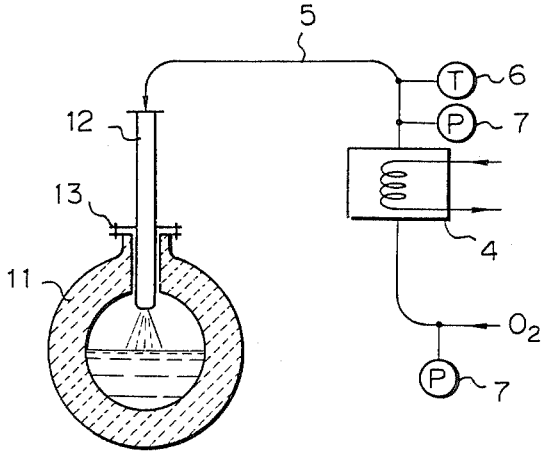
FIG. 2 is also a diagrammatical illustration of a top-blowing oxygen furnace for gasifying coal, to which a method of this invention is applied.

FIG. 2 is a diagrammatical sectional view of a coal gasification furnace with a top-blowing oxygen lance. The method of this invention may be applied successfully to such a coal gasification furnace which has to be operated continuously for a long period of time while maintaining the composition of the product gas as constant as possible even when the coal input increases or decreases. The height of the lance can be fixed during operation. In FIG. 2 the same reference numerals indicate the same members as in FIG. 1.

In the case of a coal gasification furnace which is operated continuously for a relatively long period of time, a sealing mechanism is not necessary, reducing equipment costs markedly.

There is a correlation between the stirring strength of a jet of oxygen gas at the surface of molten iron or steel and the $CO_2$ content of the product gas. That is, when the stirring strength decreases, the content of $CO_2$ gas increases. Thus, when it is required to increase the $CO_2$ content of the product gas, the pressure of the oxygen gas to be supplied is decreased.

Thus, according to this invention, without moving the lance up and down, the stirring strength as well as the supply of oxygen gas can be controlled separately. Therefore, it is possible to install a simple sealing mechanism in an oxygen converter for steel making. This is especially advantageous for reducing equipment costs in the recently-developed closed type oxygen converter.

Furthermore, additional advantages are that the distance between the lance tip and the molten metal bath surface can be kept long enough to extend the service life thereof.

This invention will be further described with reference to working examples.

EXAMPLE

A method of this invention was carried out using a gasification furnace containing a molten iron bath like that shown in FIG. 2. The results of experiments on coal gasification using the present method are compared in Tables 1 and 2 with results obtained using a prior art method in which the height of a lance was varied.

In the case of a gasification furnace containing a molten iron bath, coal is blown through a top-blowing lance onto the molten iron bath 8 together with oxygen gas so as to effect gasification of coal. The top-blowing lance 12 is fixed at a given height by a flange 13 which is mounted on the furnace.

Table 1 summarizes the test reslts for the case in which the supply of oxygen gas was decreased and increased while the stirring strength of the jet of oxygen gas was maintained constant. Table 2 shows the case in which the stirring strength was decreased and increased while maintaining the supply of the oxygen gas constant.

As is apparent from the results shown in Table 1, when the input of coal is reduced or increased, it is necessary, according to the prior art method, not only to reduce or increase the supply of oxygen gas but also to change the height of the lance, although the stirring strength of the jet of oxygen gas may be maintained constant.

However, according to this invention, it is possible to keep the height of the lance constant merely by raising or lowering the temperature of the oxygen gas even though the supply of oxygen gas is reduced or increased with the $CO_2$concentration in the product gas being kept constant.

Table 2 illustrates the case in which the $CO_2$ concentration is required to be reduced or increased, i.e., the CO content of the product gas is required to be increased or decreased. It is apparent from the experimental results shown in Table 2 that it is necessary to increase or decrease the stirring strength of a jet of oxygen gas while maintaining the supply of the oxygen gas constant.

In this situation, according to the prior art method, it is necessary that the height of the lance be changed so as to change the $CO_2$ concentration. However, according to this invention, it is possible to reduce or increase the $C_2$concentration of the product gas merely by raising or lowering the temperature of the oxygen gas without changing the height of the lance while maintaining the supply of the oxygen gas constant.

TABLE 1

| | | | (Stirring Strength: constant) | | |
|---|---|---|---|---|---|
| | Amount of oxygen gas (kg/Hr) | Amount of coal (kg/Hr) | Lance height (m) | Oxygen temp. (°C.) | $CO_2$ conc. (%) |
| Present invention | | | | | |
| Before controlling | 900 | 980 | 1.27 | 130 | 5 |
| After controlling* | 1000 | 1100 | 1.27 | 50 | 5 |
| After controlling** | 800 | 860 | 1.27 | 240 | 5 |
| Conventional | | | | | |
| Before controlling | 900 | 980 | 1.27 | 130 | 5 |
| After controlling* | 1000 | 1100 | 1.33 | 130 | 5 |
| After controlling** | 800 | 860 | 1.11 | 130 | 5 |

*The flow rate of oxygen gas was increased.
**The flow rate of oxygen gas was decreased.

TABLE 2

| | Amount of oxygen gas (kg/Hr) | Amount of coal (kg/Hr) | Lance height (m) | Oxygen temp. (°C.) | Oxygen pressure ($kg/cm^2$) | $CO_2$ conc. (%) |
|---|---|---|---|---|---|---|
| | | | (Oxygen Gas Flow Rate: constant) | | | |
| Present invention | | | | | | |
| Before controlling | 900 | 980 | 1.27 | 130 | 9 | 5 |
| After controlling* | 900 | 980 | 1.27 | 20 | 8 | 6 |
| After controlling** | 900 | 980 | 1.27 | 320 | 11 | 4 |
| Conventional | | | | | | |
| Before controlling | 900 | 980 | 1.27 | 130 | 9 | 5 |
| After controlling* | 900 | 980 | 1.34 | 130 | 9 | 6 |
| After controlling** | 900 | 980 | 1.22 | 130 | 9 | 4 |

*The stirring strength was decreased.
**The stirring strength was increased.

What is claimed is:

1. A method of controlling independently of each other the stirring strength of a jet of oxygen gas and the flow rate of the oxygen gas to be blown onto a molten metal bath in a top-blowing oxygen furnace provided with an oxygen supplying conduit, a means of detecting the temperature of the supplied oxygen gas in said oxygen supplying conduit, a means of detecting the pressure thereof, and a means of heat-exchanging with the supplied oxygen gas, controlling the stirring strength of the jet of oxygen gas and the flow rate of the oxygen gas independently of each other; maintaining a lance of the topblowing furnace at a predetermined position by controlling the temperature and the pressure of the supplied oxygen; achieving control of the stirring strength by varying the oxygen pressure while changing the oxygen temperature so as to maintain the oxygen flow rate at a given level; and, achieving control of the oxygen flow rate in the absence of variation of the stirring strength by varying the oxygen gas temperature and maintaining pressure of the oxygen unchanged.

2. A method as defined in claim 1, in which the top-blowing oxygen molten metal furnace is a top-blowing oxygen converter for producing steel.

3. A method as defined in claim 1, in which the top-blowing oxygen molten metal furnace is a top-blowing oxygen furnace for gasifying coal.

4. A method as defined in claim 1, in which the degree of stirring of the molten metal bath is controlled by means of changing the pressure of the supplied oxygen gas, and the flow rate thereof is controlled independently of the pressure by means of changing the temperature of the oxygen gas.

5. A method as defined in claim 1, in which the flow rate of the oxygen gas is reduced while increasing the stirring strength of the molten metal bath at a finishing stage of refining a low carbon steel.

6. A method of defined in claim 1, in which the temperature of the oxygen gas is varied by the heat-exchanging means and the pressure of the oxygen is varied by valve control of said oxygen supplying conduit.

7. A method as defined in claim 1, in which the stirring strength is decreased by decreasing the pressure of the oxygen gas in order to increase the $CO_2$ content of the product gas of said top-blowing furnace.

* * * * *